US009417016B2

(12) United States Patent
Scott

(10) Patent No.: US 9,417,016 B2
(45) Date of Patent: Aug. 16, 2016

(54) LAMINATED HEAT EXCHANGER

(75) Inventor: David Russell Scott, Walsall (GB)

(73) Assignee: HS MARSTON AEROSPACE LTD., Wolverhampton (GB)

( * ) Notice: Subject to any disclaimer, the term of this patent is extended or adjusted under 35 U.S.C. 154(b) by 1110 days.

(21) Appl. No.: 12/985,064

(22) Filed: Jan. 5, 2011

(65) Prior Publication Data

US 2012/0168112 A1 Jul. 5, 2012

(51) Int. Cl.
*F28F 3/02* (2006.01)
*F28D 9/00* (2006.01)
*F28D 1/03* (2006.01)

(52) U.S. Cl.
CPC . *F28F 3/02* (2013.01); *F28D 9/005* (2013.01); *F28D 9/0056* (2013.01); *F28D 9/0075* (2013.01); *F28F 3/022* (2013.01)

(58) Field of Classification Search
CPC ..... F28F 3/042; F28F 3/044; F28F 3/046; F28F 9/001; F28F 3/022; F28F 3/02; F28F 1/124; F29D 1/0308; F29D 1/0333; F29D 1/0341; F29D 1/035; F29D 1/0383; F28D 9/0075; F28D 9/0056
USPC ..... 165/153, 165, 166, 167, 170, 179
See application file for complete search history.

(56) References Cited

U.S. PATENT DOCUMENTS 1,992,097 A * 2/1935 Seligman ..... F28F 3/083 165/167
3,216,495 A * 11/1965 Johnson ..... 165/166
3,334,399 A * 8/1967 Teeguarden ..... 29/890.039
3,783,090 A * 1/1974 Andersson et al. ..... 165/166
3,931,854 A * 1/1976 Ivakhnenko et al. ..... 165/166
4,249,597 A * 2/1981 Carey ..... 165/166
4,301,863 A 11/1981 Bizzarro
4,535,840 A * 8/1985 Rosman et al. ..... 165/167
4,800,954 A 1/1989 Noguchi et al.
4,815,534 A 3/1989 Fuerschbach
5,125,451 A 6/1992 Matthews
5,544,702 A 8/1996 Nishishita
5,685,368 A * 11/1997 Yuasa et al. ..... 165/167
5,901,783 A 5/1999 Dobak, III et al.
5,911,273 A * 6/1999 Brenner et al. ..... 165/167
6,129,973 A 10/2000 Martin et al.
6,318,456 B1 * 11/2001 Brenner et al. ..... 165/167
6,340,053 B1 1/2002 Wu et al.
6,378,604 B1 * 4/2002 Feind et al. ..... 165/166
6,494,614 B1 12/2002 Bennett et al.

(Continued)

FOREIGN PATENT DOCUMENTS

EP 1526350 A2 4/2005
WO 0046564 A1 8/2000

OTHER PUBLICATIONS

Partial European Search Report for EP Application No. 12150211.6-1602, dated Jul. 10, 2015, pp. 1-6.

(Continued)

*Primary Examiner* — Tho V Duong
(74) *Attorney, Agent, or Firm* — Cantor Colburn LLP

(57) ABSTRACT

A laminated heat exchanger includes at least one heat exchange layer that includes a plurality of side members that define a frame having an interior portion. A plurality of heat exchange members extend between at least two of the plurality of side members across the interior portion. The plurality of heat exchange members are linked by a ligament member to form a heat exchange member chain.

18 Claims, 7 Drawing Sheets

(56) References Cited

U.S. PATENT DOCUMENTS

| | | | | |
|---|---|---|---|---|
| 6,827,128 | B2 | 12/2004 | Philpott et al. | |
| 6,907,920 | B2 | 6/2005 | Warburton et al. | |
| 6,968,892 | B1 | 11/2005 | Symonds | |
| 7,766,075 | B2 | 8/2010 | Vetrovec et al. | |
| 9,255,745 | B2 * | 2/2016 | Bertolotti | F28F 1/124 |
| 2002/0071797 | A1 | 6/2002 | Loffler et al. | |
| 2005/0082049 | A1 | 4/2005 | Brost | |
| 2006/0113063 | A1 | 6/2006 | Chordia et al. | |
| 2006/0151147 | A1 * | 7/2006 | Symonds | 165/11.1 |
| 2007/0221366 | A1 * | 9/2007 | Murayama et al. | 165/166 |
| 2010/0068105 | A1 | 3/2010 | Green | |

OTHER PUBLICATIONS

European Search Report for EP Application No. 12150211.6-1602, dated Oct. 26, 2015, 9 pages.

* cited by examiner

LAMINATED HEAT EXCHANGER

BACKGROUND OF THE INVENTION

Exemplary embodiments pertain to the art of heat exchangers and, more particularly, to a laminated heat exchanger.

Exchanging heat between two fluids is desirable in many applications. Heat exchangers pass a first medium having a first heat energy in proximity to another medium having a second heat energy to facilitate a transfer of the heat energy. More specifically, the mediums are passed in proximity to cause heat from the medium having the higher heat energy to the medium having a lower heat energy. The mediums can be passed in direct contact one with the other, or the mediums can be separated by a heat transfer surface. Conventional heat exchangers, particularly for aerospace applications, include plate/fin designs, or tube/shell designs.

Plate/fin heat exchangers employ sandwiched passages that contain fins. The fins provide increased surface area which leads to greater heat exchange. Plate/fin heat exchangers include both cross-flow and counter-flow designs and are provides with various fin arrangements depending on desired heat exchange characteristics. Tube/shell heat exchangers are generally incorporated into high pressure applications and include a shell, such as a pressure vessel, within which are positioned a number of tubes. One medium passes through the tubes and another medium passes through the shell and over the tubes. The tubes are typically formed from a material that facilitates a desired heat transfer. Of course, numerous other heat exchanger arrangements also exist.

BRIEF DESCRIPTION OF THE INVENTION

Disclosed is a laminated heat exchanger including at least one heat exchange layer having a plurality of side members that define a frame including an interior portion. A plurality of heat exchange members extend between at least two of the plurality of side members across the interior portion. The plurality of heat exchange members are linked by a ligament member to form a heat exchange member chain.

Also disclosed is a laminated heat exchanger including at least one heat exchange layer having a plurality of side members that define a frame including an interior portion. At least one tank member is integrally formed with at least one of the plurality of side members. The at least one tank member establishes a medium reservoir that is fluidly connected to the interior portion.

Further disclosed is a laminated heat exchanger including at least one heat exchange layer having a plurality of side members that define a frame including an interior portion. A plurality of heat exchange members extend between at least two of the plurality of side members across the interior portion. The plurality of heat exchange members are linked by a ligament member to form a heat exchange member chain. At least one tank member is integrally formed with at least one of the plurality of side members. The at least one tank member establishes a medium reservoir that is fluidly connected to the interior portion.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
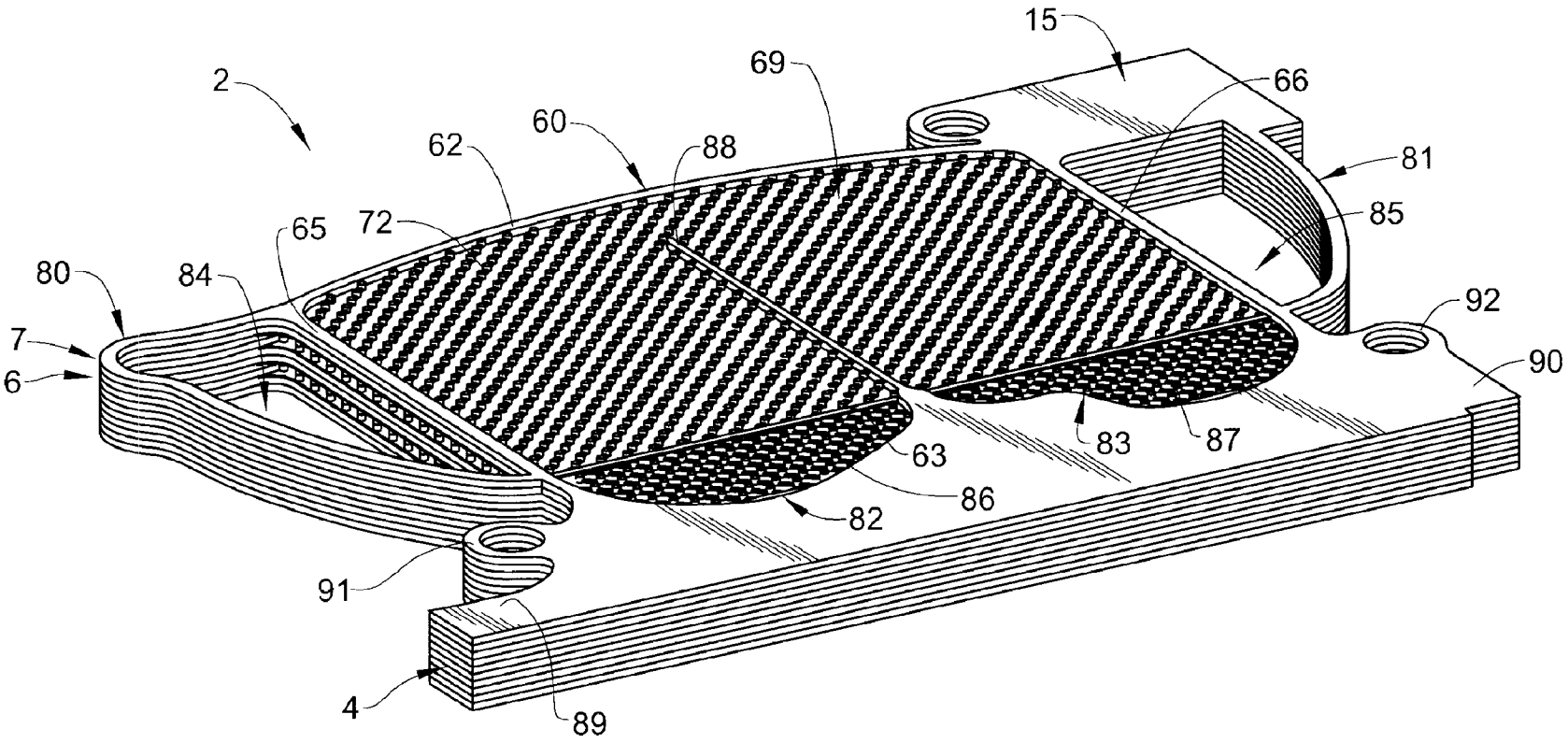
FIG. 1 is a lower left perspective view of a laminated heat exchanger constructed in accordance with an exemplary embodiment.
Figure 2:
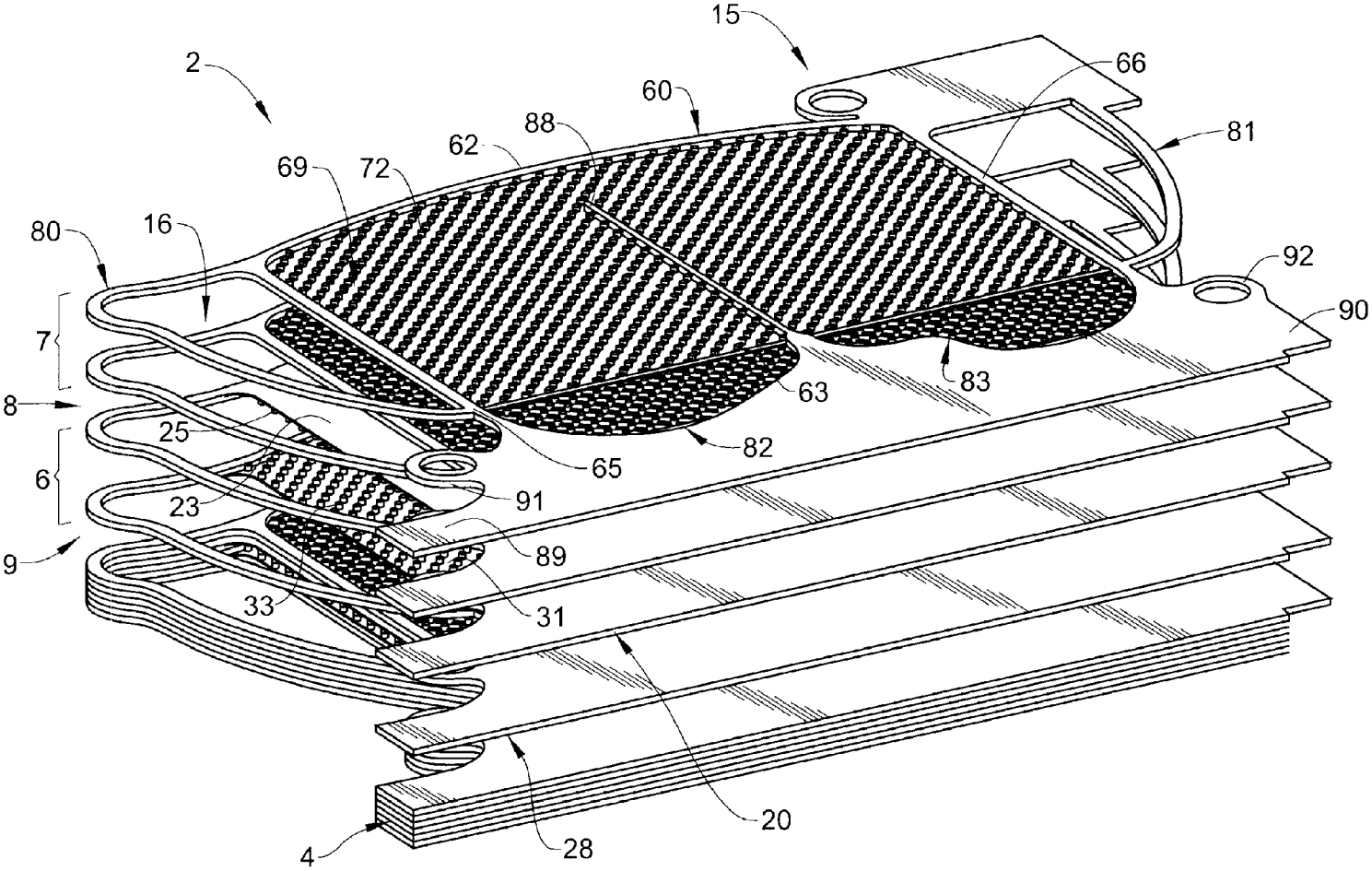
FIG. 2 is a partially exploded view of the laminated heat exchanger of FIG. 1 illustrating a plurality of heat exchange layers and a plurality of heat exchange elements.
Figure 3:
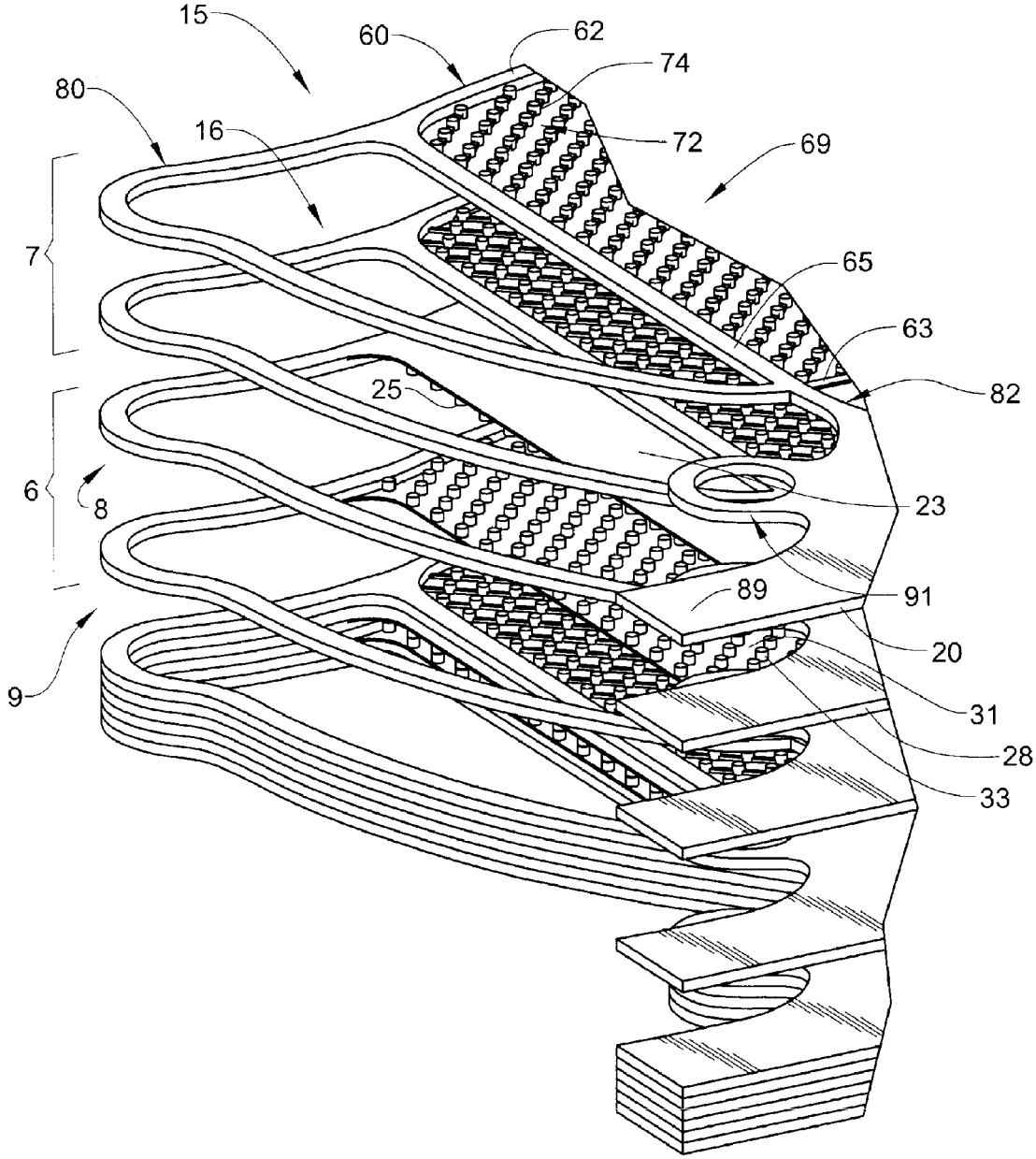
FIG. 3 is a detail view of the plurality of heat exchange layers and the plurality of heat exchange elements of the laminated heat exchanger of FIG. 2.
Figure 4:
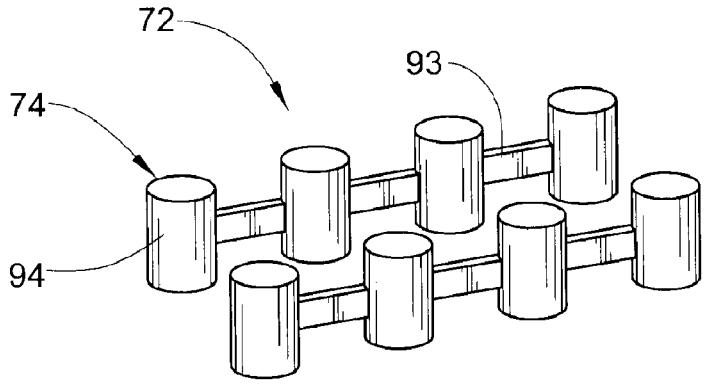
FIG. 4 is a detail view of a plurality of heat exchange member chains including a plurality of heat exchange members linked by ligament members in accordance with one aspect of the exemplary embodiment.

With reference to FIGS. 1-3, a laminated heat exchanger constructed in accordance with exemplary embodiment is indicated generally at 2. Laminated heat exchanger 2 includes a body 4 having a first medium section 6 and a second medium section 7. As will become more fully evident below, first medium section 6 is fluidly isolated from second medium section 7. In this manner, a first medium passes through first medium section 6 in a heat exchange relationship with a second medium flowing through second medium section 7. First medium section 6 includes a first heat exchange element 8 positioned directly adjacent to, and abutting, a second heat exchange element 9. Similarly, second heat exchange section 7 includes a first heat exchange layer 15 arranged adjacent to, and abutting, a second heat exchange layer 16. In addition to abutting first heat exchange layer 15, second heat exchange layer 16 abuts second heat exchange element 9. In this manner, second heat exchange element 9 defines a boundary between first and second heat exchange sections 6 and 7. At this point it should be understood that the number of heat exchange sections can vary depending upon desired heat exchange characteristics. Also, the number of heat exchange layers in a given heat exchange section could also vary.

First heat exchange element 8 includes a frame element 20 having a substantially planer surface 23 that establishes a boundary to second heat exchange section 7. First heat exchange element 8 includes plurality of heat exchange components 25 that project outward from substantially planar surface 23. Similarly, second heat exchange element 9 includes a frame element 28 having a substantially planar surface 31 that establishes a boundary to an adjacent heat exchange section (not separately labeled). Second heat exchange element 9 includes a plurality of heat exchange components 33 that project outward from substantially planar surface 31 and are positioned to register with the plurality of heat exchange components 25 on first heat exchange element 8. Heat exchange components 25 and 33 facilitate a heat transfer between first heat exchange section 6 and second heat exchange section 7.

Reference will continue to FIGS. 1-3 in describing first and second heat exchange layers 15 and 16; however, as each heat exchange layer 15 and 16 is similarly constructed, reference will be made to heat exchange layer 15 with an understanding that heat exchange layer 16 includes similar structure. In accordance with the exemplary embodiment shown, heat exchange layer 15 includes a frame 60 having first and second opposing side members 62 and 63 that are joined to third and fourth opposing side members 65 and 66 to establish an interior portion 69. Heat exchange layer 15 includes a plurality of heat exchange member chains 72 a portion of which, in the exemplary embodiment shown, extend between adjacent ones of side members 62, 65 and 63, 66 forming a heat exchange core (not separately labeled). In the exemplary embodiment shown, the heat exchange core has a generally rectangular shape/form. However it should be understood that the particular shape/form of the heat exchange core can vary. Each heat exchange member chain 72 is formed from a plurality of linked heat exchange members 74 as will be detailed more fully below.

First heat exchange layer 15 also includes a plurality of integrated tank members 80-83 that are integrally formed with frame 60. In the exemplary embodiment shown, tank member 80 extends from side member 65 through a curvilinear section (not separately labeled) and rejoins side member 65. Similarly, tank member 81 extends from side member 66 through a curvilinear section (not separately labeled) and rejoins side member 66. Tank members 82 and 83 extend from side member 63 through corresponding curvilinear sections (not separately labeled) and rejoin side member 65. Tank members 80-83 join with tank members (not separately labeled) on heat exchange elements 8 and 9 as well as second heat exchange layers 16 to form a corresponding plurality of tanks or reservoirs 84-87 that are configured to hold one of a first heat exchange medium and a second heat exchange medium. In accordance with one aspect of the exemplary embodiment, tanks 84 and 85 define an inlet and an outlet respectively for a first heat exchange medium passing through first medium section 6. Towards that end, first medium section 6 is fluidly connected to tanks 84 and 85. Similarly, tanks 86 and 87 define an inlet and an outlet respectively for a second heat exchange medium flowing through second medium section 7. In order to enhance contact with heat exchange member 74 and guide the second medium between tank 86 and 87, first heat exchange layer 15 includes a medium guide member 88 that extends from side wall 63 toward side wall 62. First heat exchange layer 15 is also shown to include a pair of frame flanges 89 and 90 that are machined to produce a desired interface between laminated heat exchanger 2 and a component such as a portion of an airframe. First heat exchange layer 15 is further shown to include a pair of mold members 91 and 92. Mold members 91 and 92 are formed when producing first heat exchange layer 15 and may be used to establish a desired alignment between adjacent first and second medium sections 6 and 7.

Figure 5:
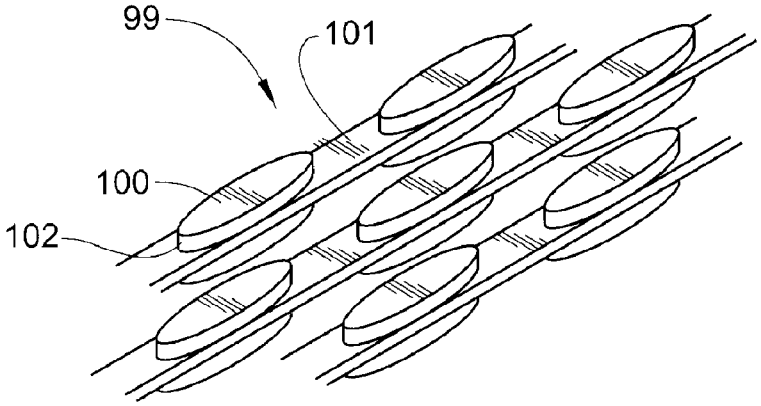
FIG. 5 is a detail view of a plurality of heat exchange member chains including a plurality of heat exchange members linked by ligament members in accordance with another aspect of the exemplary embodiment.
Figure 6:
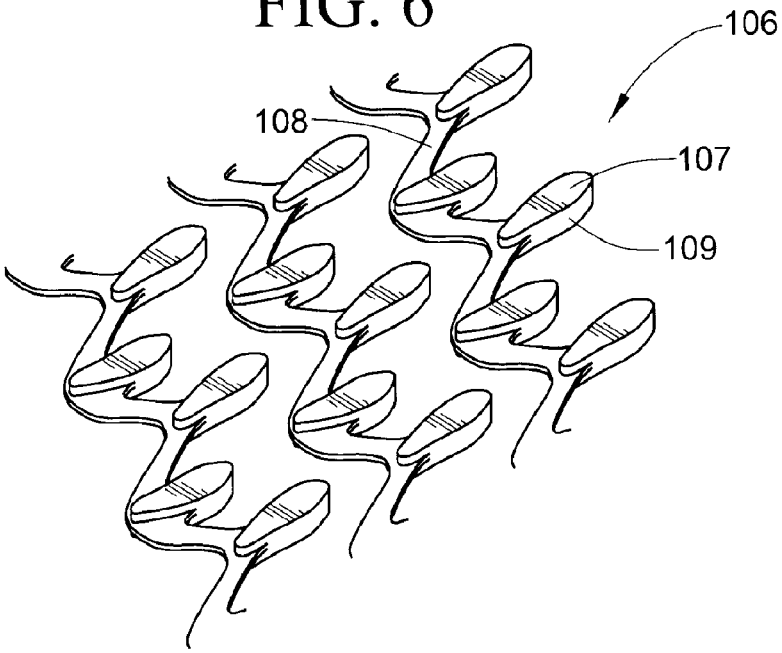
FIG. 6 is detail view of a plurality of heat exchange member chains including a plurality of heat exchange members linked by ligament members in accordance with still another aspect of the exemplary embodiment.
Figure 7:
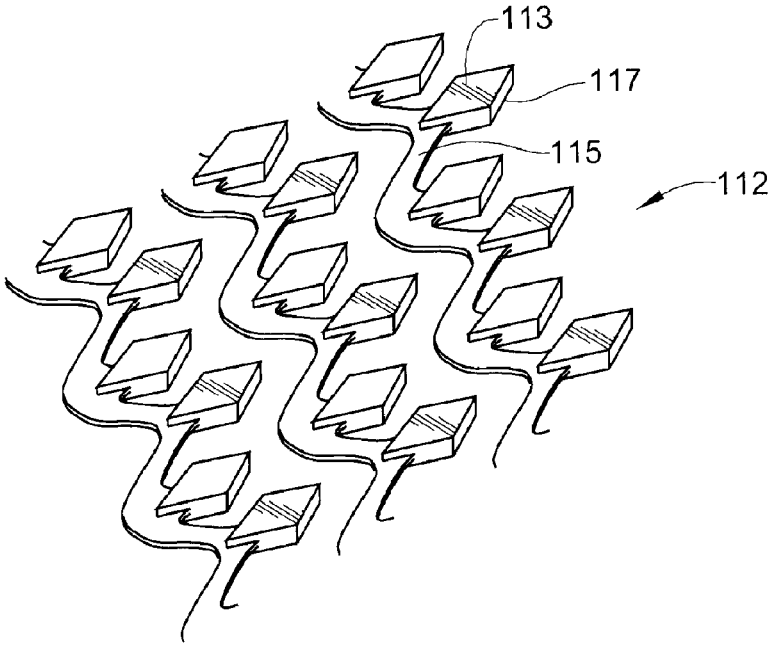
FIG. 7 is a detail view of a plurality of heat exchange member chains including a plurality of heat exchange members linked by ligament members in accordance with yet another aspect of the exemplary embodiment.

Reference will now be made to FIGS. 4-7 in describing heat exchange member chains in accordance with various aspects of the exemplary embodiment. In accordance with one aspect of the exemplary embodiment, heat exchange members 74 are joined by ligament members 93 to form heat exchange member chain 72. In the exemplary aspect illustrated in FIG. 4, each heat exchange member 74 includes an outer surface 94 that defines a circular cross-section. In FIG. 5, a heat exchange member chain 99 is shown having a plurality of heat exchange members 100 joined by ligament members 101. Each heat exchange member 100 includes an outer surface 102 that defines an oval cross-section. FIG. 6 illustrates a heat exchange member chain 106 formed from a plurality of heat exchange members 107 joined by ligament members 108. Heat exchange member 107 includes an outer surface 109 that defines an airfoil shaped cross-section. In FIG. 7, a heat exchange member chain 112 is shown to include a plurality of heat exchange members 113 joined by ligament members 115. Heat exchange members 113 have an outer surface 117 that defines a diamond shaped cross-section.

Figure 8:
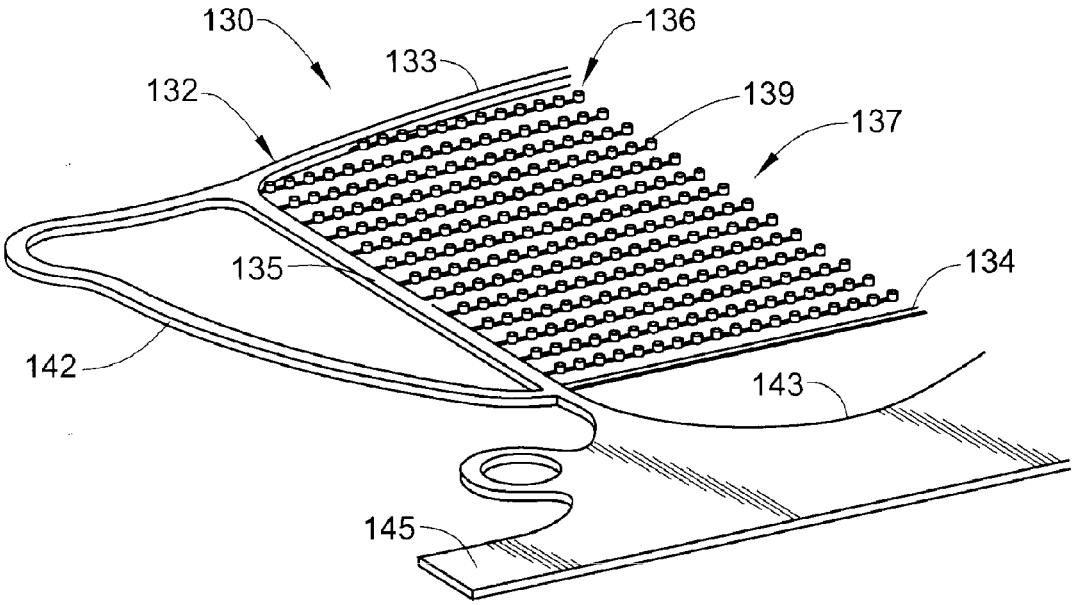
FIG. 8 is a detail view of one of the plurality of heat exchange layers in accordance with one aspect of the exemplary embodiment.

FIG. 8 illustrates a heat exchange layer 130 formed in accordance with an alternative aspect of the exemplary embodiment. Heat exchange layer 130 includes a frame 132 having first and second opposing side members 133 and 134 that are joined by a third side member 135 and a fourth side member (not shown) to define an interior portion 136. Heat exchange layer 130 includes a plurality of heat exchange member chains 137 formed from a plurality of linked heat exchange members 139. In contrast to the above described arrangement, all heat exchange member chains 137 extend between opposing side members, i.e., third side member 135 and the fourth side member (not shown). In a manner similar to that described above, heat exchange layer 130 is shown to include tank members 142 and 143, and a frame flange 145. At this point it should be understood that the particular size, shape and arrangement of heat exchange member chains 137 can vary.

Figure 9:
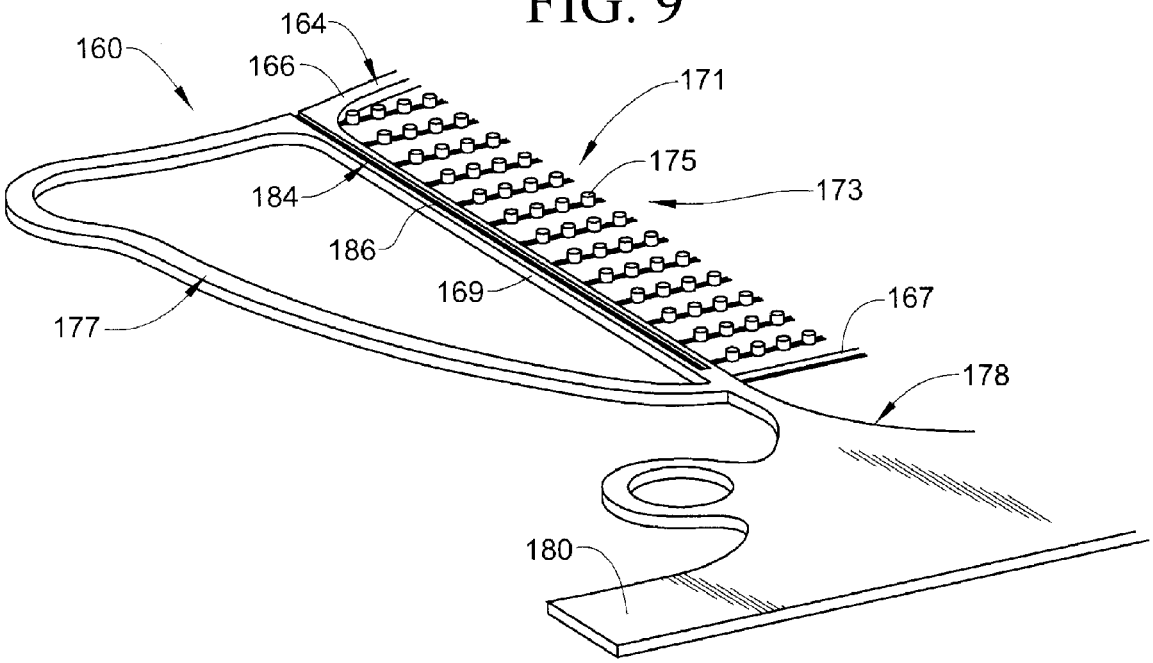
FIG. 9 is a detail view of one of the plurality of heat exchange layers illustrating a leak detector member in accordance with an exemplary embodiment.

Reference will now be made to FIG. 9 in describing a heat exchange layer 160 in accordance with another aspect of the exemplary embodiment. Heat exchange layer 160 includes a frame 164 having first and second opposing side members 166 and 167 that are joined by a third side member 169 and a fourth side member (not shown) to define an interior portion 171. Heat exchange layer 160 includes a plurality of heat exchange member chains 173 formed from a plurality of linked heat exchange members 175. Heat exchange layer 160 is also shown to include tank members 177 and 178, and a frame flange 180. Heat exchange layer 160 is further shown to include a leak detector member 184 shown in the form of a channel 186 formed in side member 169. In the event of a tank leak or a leak from interior portion 171, medium will flow into channel 186 and exit from laminated heat exchanger 2 thereby providing a visual indication of a leak. Alternatively, the leak detector members(s) on each heat exchange layer are fluidly connected and routed to a pressure sensor (not shown) that provides a signal indicating a leakage before two heat exchange mediums can come into contact or leak externally.

Figure 10:
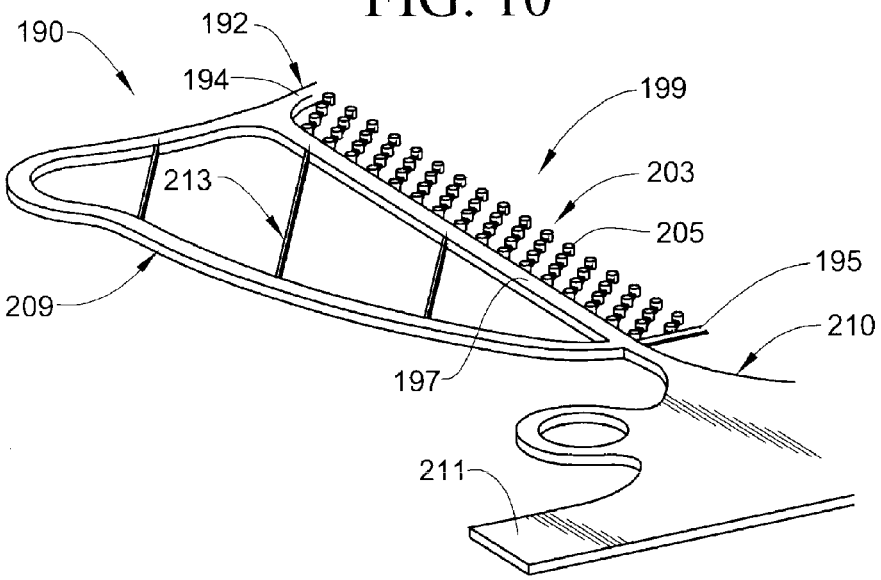
FIG. 10 is a detail view of one of the plurality of heat exchange layers illustrating an integrated tank member support element in accordance with an exemplary embodiment.

Reference will now be made to FIG. 10 in describing a heat exchange layer 190 constructed in accordance with yet another aspect of the exemplary embodiment. Heat exchange layer 190 includes a frame 192 having first and second opposing side members 194 and 195 that are joined by a third side member 197 and a fourth side member (not shown) to define an interior portion 199. Heat exchange layer 190 includes a plurality of heat exchange member chains 203 formed from a plurality of linked heat exchange members 205. Heat exchange layer 190 is also shown to include tank members 209 and 210, and a frame flange 211. In accordance with the exemplary aspect shown, heat exchange layer 190 includes a plurality of tank member support elements, one of which is indicated at 213. Tank member support elements 213 extend between adjacent portions of tank member 209 and/or between tank member 209 and side member 197. Tank member support elements 213 provide internal structural support for a medium tank associated with heat exchange layer 190. At this point it should be understood that laminated heat exchanger 2 could be formed with one or more heat exchange layers 190 depending upon a need for stiffening the medium tank. It should also be understood that tank member 210 could also be provided with tank member support elements.

Figure 11:
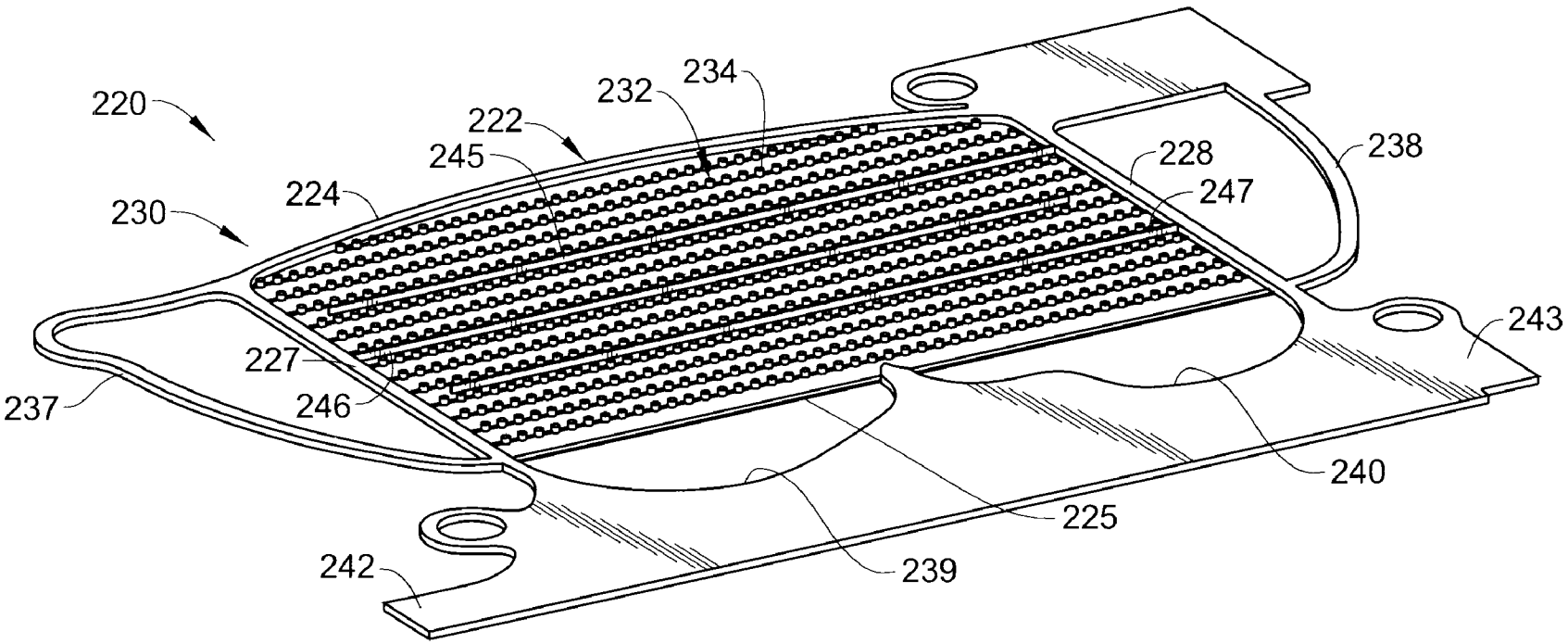
FIG. 11 is a perspective view of one of the plurality of heat exchange layers in accordance with another aspect of the exemplary embodiment.

Reference will now be made to FIG. 11 in describing a heat exchange layer 220 constructed in accordance with yet another aspect of the exemplary embodiment. Heat exchange layer 220 includes a frame 222 having first and second opposing side members 224 and 225 that are joined by a third side member 227 and a fourth side member 228 to define an interior portion 230. Heat exchange layer 220 includes a plurality of heat exchange member chains 232 formed from a plurality of linked heat exchange members 234. Heat exchange layer 220 is also shown to include tank members 237-240, and frame flanges 242 and 243. In accordance with the exemplary aspect shown, heat exchange layer 220 includes a plurality of medium guide members 245-247. Medium guide member 245 extends from side member 228 across interior portion 230 toward side member 227; medium guide member 246 extends from side member 227 across interior portion 230 toward side member 228; and medium guide member 247 extends from side member 228 across interior portion 230 toward side member 227. In this manner, medium guide members establish a serpentine or curvilinear flow path between tank member 237 and tank member 238. Medium guide members 245-247 may be employed when interior portion 230 is fluidly connected to tank members 237 and 238 in order to prolong medium residence time within the medium section and enhance heat exchange.

At this point it should be understood that the exemplary embodiment provide a laminated heat exchanger formed from heat exchange layers that can be joined one to another to form a medium section. The number of heat exchange layers can vary. In addition, forming the heat exchange layers with heat exchange member chains eases manufacturing while at the same time providing a flexible building block for a laminated heat exchanger. That is, by eliminating a planar surface previous employed to support heat exchange members, multiple heat exchange layers can be combined to form a medium section. Finally, it should be understood that the material used to form the heat exchange layer can very depending upon desired design characteristics.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A laminated heat exchanger comprising:

a first medium section having a first heat exchange element including a first frame element having a first substantially planar surface and a first plurality of heat exchange components extending substantially perpendicularly from the first planar surface, and a second heat exchange element including a second frame element having a second substantially planar surface facing the first substantially planar surface and a second plurality of heat exchange components extending substantially perpendicularly from the second planar surface toward the first plurality of heat exchange components; and a second medium section mounted to and fluidically isolated from the first medium section, the second medium section having at least one heat exchange layer including a plurality of side members that define a frame having an interior portion, a plurality of heat exchange members extending between at least two of the plurality of side members across the interior portion, the plurality of heat exchange members being linked only by a ligament member to form a heat exchange member chain that is only connected to the at least two of the plurality of side members.

2. The laminated heat exchanger according to claim 1, further comprising: a plurality of heat exchange member chains extending between the at least two of the plurality of side members.

3. The laminated heat exchanger according to claim 1, wherein the at least two of the plurality of side members comprise adjacent side members.

4. The laminated heat exchanger according to claim 1, wherein the at least two of the plurality of side members comprises opposing side members.

5. The laminated heat exchanger according to claim 1, wherein each of the plurality of heat exchange members includes a circular cross-section.

6. The laminated heat exchanger according to claim 1, wherein each of the plurality of heat exchange members includes an oval cross-section.

7. The laminated heat exchanger according to claim 1, wherein each of the plurality of heat exchange members includes an airfoil cross-section.

8. A laminated heat exchanger comprising:

a first medium section having a first heat exchange element including a first frame element having a first substantially planar surface and a first plurality of heat exchange components extending substantially perpendicularly from the first planar surface, and a second heat exchange element including a second frame element having a second substantially planar surface facing the first substantially planar surface and a second plurality of heat exchange components extending substantially perpendicularly from the second planar surface toward the first plurality of heat exchange components; and a second medium section mounted to and fluidically isolated from the first medium section, the second medium section having at least one heat exchange layer including a plurality of side members that define a frame having an interior portion, a first tank member integrally formed with at least one of the plurality of side members, a second tank member integrally formed with the one of the plurality of side members and arranged alongside and on the same one of the plurality of side members as the first tank member, each of the first and second tank members establishing a medium reservoir that is fluidly connected to the interior portion the first tank member defining a medium inlet and the second tank member defining a medium outlet, and a plurality of heat exchange members extending between at least two of the plurality of side members across the interior portion, the plurality of heat exchange members being linked only by a ligament member to form a heat exchange member chain that is only connected to the at least two of the plurality of side members.

9. The laminated heat exchanger according to claim 8, wherein at least one of the first and second tank member extends from the at least one of the plurality of side members through a curvilinear section and re-joins the at least one of the plurality of side members.

10. The laminated heat exchanger according to claim 8, further comprising: a plurality of medium guide members arranged in the interior portion, each of the plurality of medium guide members extending from a select one of the plurality of side members to establish a curvilinear flow path for medium passing between the inlet and the outlet.

11. The laminated heat exchanger according to claim 8, further comprising: a leak detector member provided in the second layer.

12. The laminated heat exchanger according to claim 11, wherein the leak detector comprises a channel formed in the at least one of the plurality of side members between the interior portion and the at least one tank member.

13. The laminate heat exchanger according to claim 8, further comprising: at least one tank member support element arranged in the at least one tank member.

14. The laminate heat exchanger according to claim 13, wherein the at least one tank support member extends between the at least one tank member and the at least one of the plurality of side members.

15. The laminate heat exchanger according to claim 8, further comprising:

at least one frame flange integrally formed with one of the plurality of side members.

16. The laminate heat exchanger according to claim 15, wherein the at least one frame flange includes a first frame flange and a second frame flange, each of the first and second frame flanges being integrally formed with the one of the plurality of side members.

17. The laminated heat exchanger according to claim 8, further comprising: third and fourth tank members integrally formed with another of the plurality of side members.

18. A laminated heat exchanger comprising:

a first medium section having a first heat exchange element including a first frame element having a first substantially planar surface and a first plurality of heat exchange components extending substantially perpendicularly from the first planar surface, and a second heat exchange element including a second frame element having a second substantially planar surface facing the first substantially planar surface and a second plurality of heat exchange components extending substantially perpendicularly from the second planar surface toward the first plurality of heat exchange components; and a second medium section mounted to and fluidically isolated from the first medium section, the second medium section having at least one heat exchange layer including a plurality of side members that define a frame having an interior portion, a plurality of heat exchange members extending between at least two of the plurality of side members across the interior portion, the plurality of heat exchange members being linked only by a ligament member to form a heat exchange member chain that is only connected to the at least two of the plurality of side members, and at least one tank member integrally formed with at least one of the plurality of side members, the at least one tank member establishing a medium reservoir that is fluidly connected to the interior portion.

* * * * *